US007020675B2

(12) United States Patent
Comer et al.

(10) Patent No.: US 7,020,675 B2
(45) Date of Patent: Mar. 28, 2006

(54) MULTIPLIER USING MOS CHANNEL WIDTHS FOR CODE WEIGHTING

(75) Inventors: David J. Comer, Springville, UT (US); Aaron K. Martin, Hillsboro, OR (US); James E. Jaussi, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 838 days.

(21) Appl. No.: 10/106,736

(22) Filed: Mar. 26, 2002

(65) Prior Publication Data

US 2003/0187903 A1 Oct. 2, 2003

(51) Int. Cl.
*G06G 7/16* (2006.01)

(52) U.S. Cl. ..... 708/835; 327/356

(58) Field of Classification Search ..... 708/835; 327/356

See application file for complete search history.

(56) References Cited

U.S. PATENT DOCUMENTS 4,801,827 A * 1/1989 Metz ..... 327/356
5,438,296 A * 8/1995 Kimura ..... 327/560
5,990,737 A * 11/1999 Czarnul et al. ..... 330/69
6,456,142 B1 * 9/2002 Gilbert ..... 327/356

* cited by examiner

*Primary Examiner*—Tan V. Mai
(74) *Attorney, Agent, or Firm*—Schwegman, Lundberg, Woessner & Kluth, P.A.

(57) ABSTRACT

A multiplier includes an input stage to receive input signals to provide currents at a plurality of source nodes. An output stage includes a plurality of transistors groups, each of the transistor groups has a plurality of binary weighted transistor pairs. A select unit selects the binary weighted transistor pairs based on binary code signals so that each transistor pair passes a current from one of the source nodes to either a reference node or a summing node.

30 Claims, 6 Drawing Sheets

MULTIPLIER USING MOS CHANNEL WIDTHS FOR CODE WEIGHTING

FIELD

Embodiments of the present invention relate generally to electrical signal processing and, in particular, to multipliers.

BACKGROUND

Certain signal processing applications use multipliers to perform mathematic operations such as multiplication. A multiplier multiplies one or more input signals to produce a product signal that is proportional to the input signals.

Some multipliers multiply input voltage signals with a weighting voltage signal to produce product signals that are proportional to the input voltage signals. In some cases, the input voltage signals and the weighting voltage signal are analog voltages that can be continuously variable. For linear operation, the magnitudes of both signals are kept somewhat limited. If the magnitudes are not limited, non-linear operation can result and the range of the multiplication is limited.

For these and other reasons stated below, and which will become apparent to those skilled in the art upon reading and understanding the present specification, there is a need for an improved multiplier.

DESCRIPTION OF EMBODIMENTS

Figure 1:
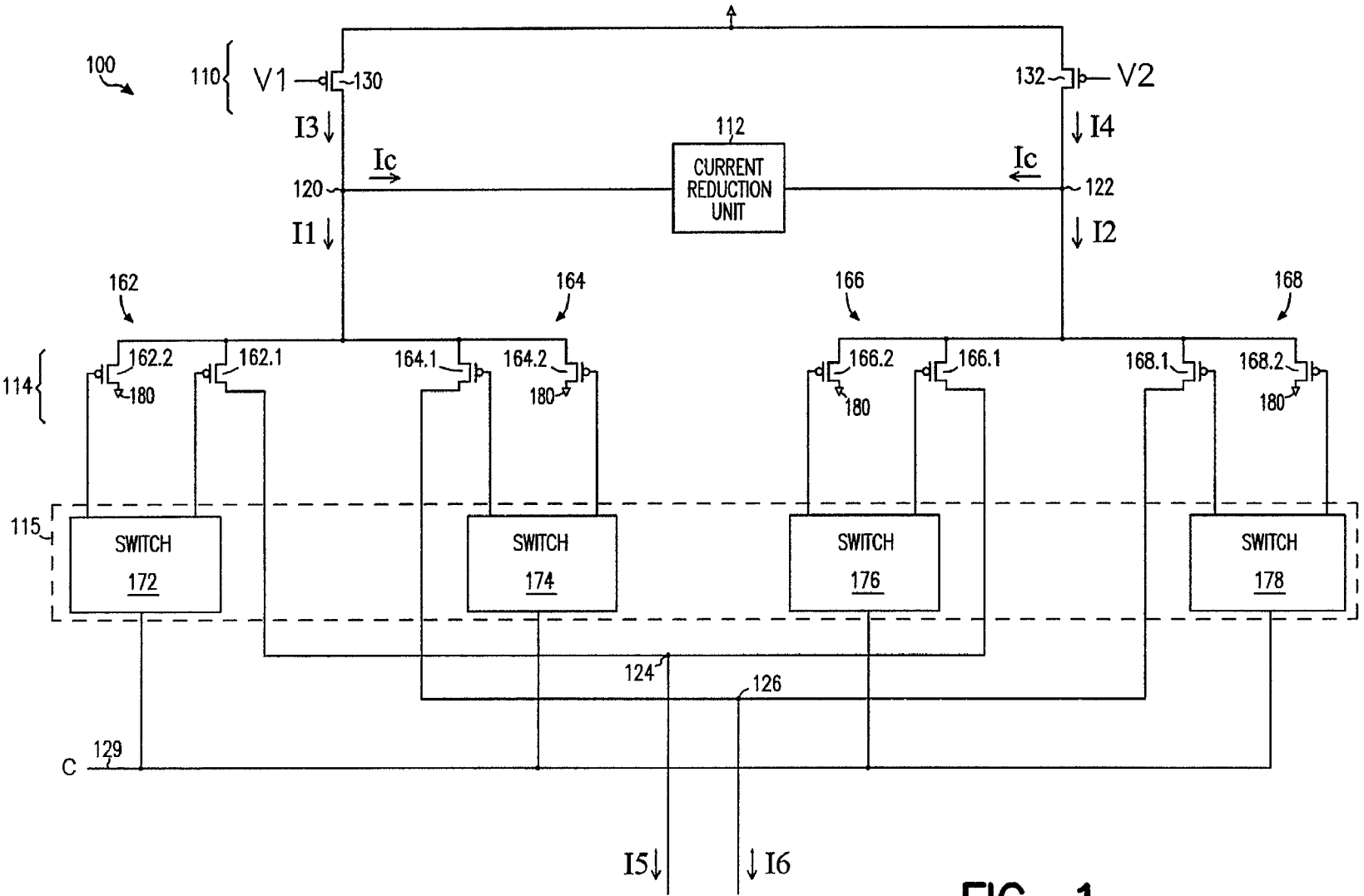
FIG. 1 shows a multiplier.

The following detailed description of the embodiments refers to the accompanying drawings that show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be used and structural, logical, and electrical changes may be made without departing from the scope of the present invention. Moreover, the various embodiments of the invention, although different, are not necessarily mutually exclusive. For example, a particular feature, structure, or characteristic described in one embodiment may be included within other embodiments. Therefore, the following detailed description is not to be taken in a limiting sense, and the scope of the present invention is defined only by the appended claims, along with the full scope of equivalents to which such claims are entitled.

FIG. 1 shows a multiplier 100. Multiplier 100 includes an input stage 110, a current reduction unit 112, an output stage 114, a select unit 115, source nodes 120 and 122, summing nodes 124 and 126, and code input node 129.

Input stage 110 includes input transistors 130 and 132 to receive V1 and V2 and generate input currents I3 and I4. A portion of I3 feeds to output stage I14 as I1. A portion of I4 feeds to output stage I14 as I2.

Current reduction unit 112 subtracts a DC current Ic from I3 and I4. Thus, I1=I3−Ic and I2=I4−Ic.

Output stage 114 includes a plurality of transistor groups 162, 164, 166, and 168. Each of the transistor groups includes a transistor pair; one transistor of the transistor pair connects between one of nodes 120 and 122 and one of node 124 and 126; the other transistor connects between one of the nodes 120 and 122 and a reference node 180. For example, in transistor group 162, transistor pair 162.1 connects between nodes 120 and 124; transistor 162.2 connects between nodes 120 and 180.

Each transistor pair passes a current from one of the source nodes 120 and 122 to either a reference node 180 or one of the summing nodes 124 and 126.

Select unit 115 includes a plurality of switches 172, 174, 176, and 178. Each of the switches connects to one transistor pair. Each switch turns on one transistor of the transistor pair based on the code signal C to allow a current from one of the nodes 120 and 122 to pass to either node 180 or one of the nodes 124 and 126. In some embodiments, the code signal C has different signal levels; each signal level turns on a different transistor of the transistor pair.

Multiplier 100 outputs I5 and I6 at node 124 and 126 proportional to V1 and V2 when the code signal C has a certain signal level that turns on the transistors connected to summing nodes 124 and 126. I5 and I6 are zero when the code signal C has a certain signal level that turns on the transistors connected to reference node 180.

Figure 2:
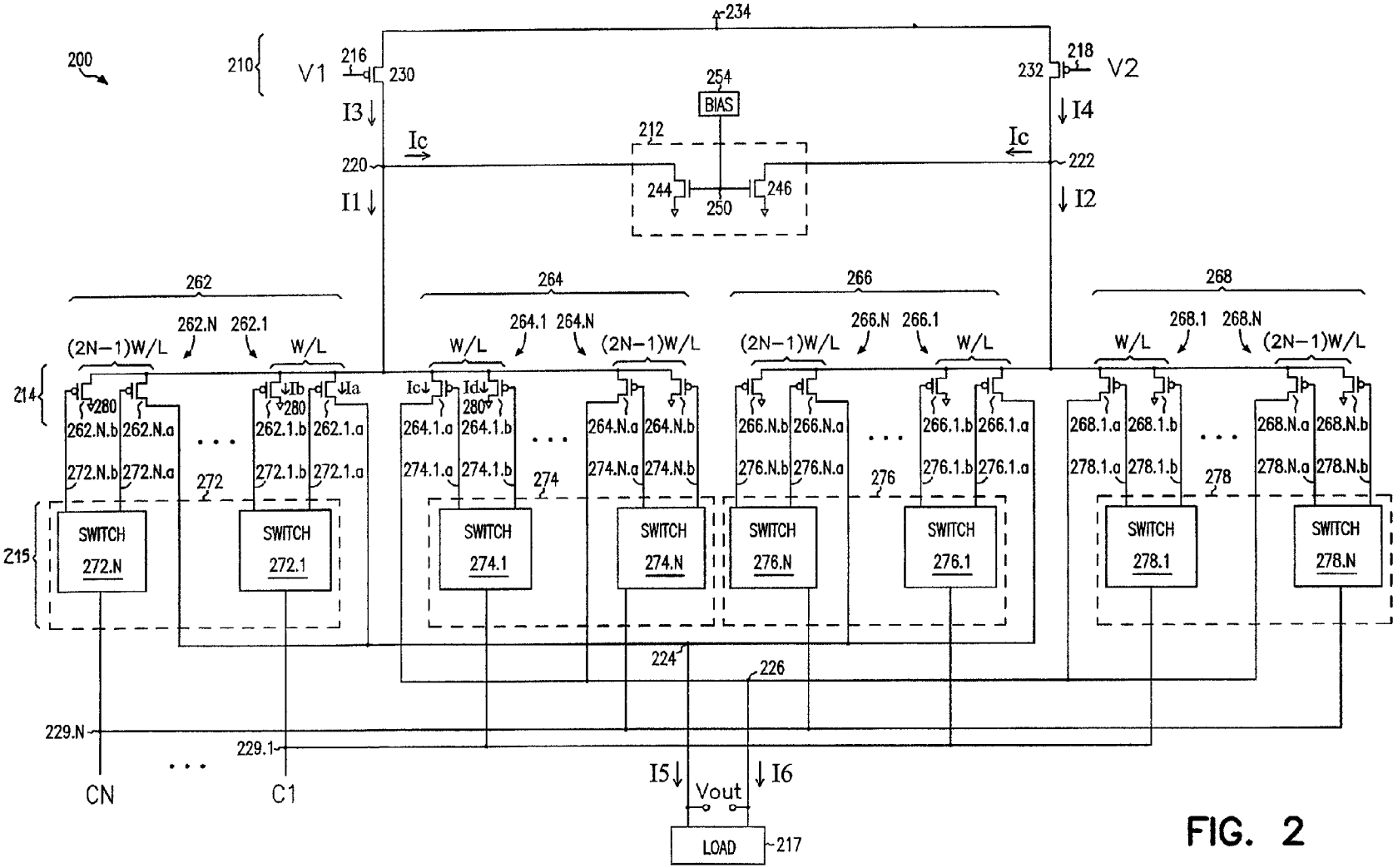
FIG. 2 shows a multiplier having weighted transistor pairs.

FIG. 2 shows a multiplier having weighted transistor pairs. Multiplier 200 includes an input stage 210, a current reduction unit 212, an output stage 214, a select unit 215, a load unit 217, input nodes 216 and 218, source nodes 220 and 222, summing nodes 224 and 226, and code input nodes 229.1 through 229.N. Input stage 210 connects to nodes 216 and 218 to receive input signals V1 and V2. Current reduction unit 212 connects to nodes 220 and 222 and draws a current Ic from nodes 220 and 222. Output stage 214 connects to nodes 220 and 222 to receive currents I1 and I2. Output stage 214 also provides a double-ended output voltage Vout at nodes 224 and 226 based on an output current I5 flowing through node 224 and an output current I6 flowing through node 226. Select unit 215 connects nodes 229.1 to 229.N to receive a plurality of code input signals C1 through CN (C1–CN).

In embodiments represented by FIG. 2, V1 and V2 are analog input voltage signals. C1–CN represent a digital word. I5 and I6 are the product of the digital word (C1–CN), V1 and V2, and a constant K1. K1 is a function of the channel widths of transistors of output stage 214. Vout is a product of I5 and I6 and a constant K2. K2 is a function of load unit 217. In some embodiments, load unit 217 is a linear load and Vout is proportional I5 and I6.

Input stage 210 includes input transistors 230 and 232. Transistor 230 has a source connected to a supply node 234, a drain connected to node 220, and a gate connected to node 216. Transistor 232 has a source connected to node 234, a drain connected to node 222, and a gate connected to node 218.

Transistors 230 and 232 form a pair of transistors to receive V1 and V2 and generate input currents I3 and I10. In some embodiments, transistors 230 and 232 are differential pair of transistors and V1 and V2 are differential voltage signals, in which V1 swings in one direction while V2 swings in the opposite direction. Transistor 230 receives V1 at its gate and converts it into I3 at its drain. Transistor 232 receives V2 at its gate and converts it into I2. A portion of I3 feeds to output stage 214 as I1. A portion of I4 feeds to output stage 214 as I2. In some embodiments, transistors 230 and 232 are constructed such that I3 is a linear function of V1, and I4 is a linear function of V2. For example, in some embodiments, transistors 230 and 232 are constructed to have appropriate channel lengths such that I3 is proportional to V1 and I4 is proportional to V2.

Current reduction unit 212 subtracts an unused portion of a DC current from I3 and I4. I3 is a mix of a DC current and a signal current generated by V1 and I4 is a mix of a DC current and a signal current generated by V2. Current reduction unit 212 subtracts an unused portion of the DC current from I3 to provide I1 and an unused portion of the DC current from I4 provide I2. Ic is the unused portion of the DC current. Thus, I1=I3−Ic and I2=I4−Ic.

Current reduction unit 212 includes transistors 244 and 246 having gates connected to a common node 250 to receive a bias voltage Vbias. A bias unit 254 generates Vbias. Transistor 244 form a first current source connected between nodes 250 and 220 to subtract Ic from node 220. Transistor 246 form a second current connected between nodes 250 and 222 to subtract Ic from node 222. Ic can be adjusted by choosing an appropriate Vbias.

Output stage 214 includes a plurality of transistor groups 262, 264, 266, and 268. One-half of the transistor groups connects to node 220 and the other half connects to node 222. For example, transistor groups 262 and 264 connect to node 220, and transistor groups 266 and 268 connect to node 222. Each of the transistor groups includes a plurality of transistor pairs. Each transistor pair has two transistors. For example, transistor group 262 includes transistor pair 262.1 through transistor pair 262.N. Transistor pair 262.1 has transistors 262.1.*a* and 262.1.*b*. Transistor pair 262.N has transistors 262.N.a and 262.N.b. Other transistor groups have transistor pairs arranged in a similar manner as the transistor pairs of transistor group 262. Transistor group 264 includes transistor pair 264.1 through transistor pair 264.N; transistor pair 264.1 has transistors 264.1.*a* and 264.1.*b*; transistor pair 264.N has transistors 264.N.a and 264.N.b. Transistor group 266 includes transistor pair 266.1 through transistor pair 266.N; transistor pair 266.1 has transistors 266.1.*a* and 266.1.*b*; transistor pair 266.N has transistors 266.N.a and 266.N.b. Transistor group 268 includes transistor pair 268.1 through transistor pair 268.N; transistor pair 268.1 has transistors 268.1.*a* and 268.1.*b*; transistor pair 268.N has transistors 268.N.a and 268.N.b.

Output stage 214 produces Vout at nodes 224 and 226 based on I5 and I6. The values of I5 and I6 depend on which transistor pairs of output stage 214 are selected to pass currents from nodes 220 and 222 to nodes 224 and 226. Select unit 215 selects the transistor pairs of output stage 214 based on a value represented by C1–CN. Different values represented by C1–CN cause select unit 215 to select different transistor pairs of output stage 214 such that currents flowing from nodes 220 and 222 through the selected transistor pairs are a function of channel widths of the transistor pairs.

In embodiments represented by FIG. 2, transistors of input stage 210 and output stage 214 are p-channel metal oxide semiconductor field effect transistors (PMOSFET), also referred to as "PFET" or "PMOS". In some embodiments, these transistors are n-channel metal oxide semiconductor field effect transistors (NMOSFET) also referred to as "NFET" or "NMOS". Other types of transistors can also be used in place of the NMOS and PMOS transistors. For example, embodiments exist that use bipolar junction transistors (BJTs) and junction field effect transistors (JFETs). One of ordinary skill in the art will understand that many other types of transistors can be used in alternative embodiments the present invention.

In each of transistor groups 262, 264, 266, and 268, N is an integer equal to or greater than two. Therefore, each transistor group includes at least two transistor pairs. In some embodiments, other transistor pairs exist in each of the transistor groups. A series of dots in FIG. 2 represents the other transistor pairs in each of the transistor groups.

The transistor pairs of transistor groups 262 and 264 have a corresponding common source connected to node 220. The transistor pairs of transistor groups 266 and 268 have a corresponding common source connected to node 222. Each transistor pair has two current paths: a first current path and a second current path. The first current path connects between the corresponding common source and node 224 or node 226. The first current path passes a portion of current from the corresponding common source to node 224 or node 226. The second current path connects between the corresponding common source and a reference node 280. The second current path passes a current from the corresponding common source to reference node 280. For example, in transistor group 262, transistor 262.1.*a* has a source connected to node 220 and a drain connected to node 224 to form a first current path between nodes 220 and 224. Transistor 262.1.*a* passes a current Ia, from node 220 to node 224. Ia is a portion of I1. Transistor 262.1.*b* has a source connected to node 220 and a drain connected to node 280 to form a second current path between nodes 220 and 280. Transistor 262.1.*b* passes a current Ib from node 220 to node 280. Ib is a portion of I1. Similarly, transistor pair 262.N has two current paths. Transistor 262.N.a forms a first current path between nodes 220 and 224, and transistor 262.N.b forms a second current path between nodes 220 and 280. For clarity, not all reference nodes are labeled with reference number 280.

Other transistor groups have a similar arrangement as transistor group 262. In transistor group 264, each of the transistor pairs forms a first current path between nodes 220 and 226 to pass a current from node 220 to node 226, and a second current path between nodes 220 and 280 to pass a current from node 220 to node 280. For example, transistor 264.1.*a* forms a first current path to pass a current Ic from node 220 to node 226. Ic is a portion of I1. Transistor 264.1.*b* forms a second current path to pass a current Id from node 220 to node 280. Id is a portion of I1. In transistor group 266, each of the transistor pairs forms a first current path between nodes 222 and 224 to pass a current from node 222 to node 224, and a second current path between nodes 222 and 280 to pass a current from node 222 to node 280. In transistor group 268, each of the transistor pairs forms a first current path between nodes 222 and 226 to pass a current from node 222 to node 226, and a second current path between nodes 222 and 280 to pass a current from node 222 to node 280.

Each of the transistors of output stage 214 has a channel width and a channel length. In FIG. 2, W indicates the channel width, and L indicates the channel length. In some embodiments, the transistors of output stage 214 have equal channel lengths as indicated by L.

The transistor pairs within the same transistor group are arranged from a least significant to most significant positions. For example, transistor group 262 starts with the least significant transistor pair 262.1 and ends with the most significant transistor pair 262.N. Similarly, transistor pairs in each of transistor groups 264, 266, and 268 also arrange from a least-to-most significant position (or from a first to N-th position).

In some embodiments, the transistor pairs of transistor groups 262, 264, 266, and 268 are weighted transistor pairs such that all transistor pairs have equal channel lengths. Transistors in the same transistor pair have equal channel widths, and transistors in different transistor pairs have unequal channel widths. For example, transistors 262.1.*a* and 262.1.*b* have equal channel widths. Transistors 262.N.a and 262.N.b have equal channel widths that are unequal to the channel widths of transistors 262.1.*a* and 262.1.*b*.

In some other embodiments, the transistor pairs of the transistor groups 262, 264, 266, and 268 are weighted transistor pairs such that all transistor groups have equal channel lengths. Transistor pairs in a particular significant position have channel widths that are a multiple of the channel widths of transistor pairs in a lower significant position within the same transistor group. For example, transistors 262.N.a and 262.N.b have channel widths that are a multiple of the channel widths of transistors 262.1.*a* and 262.1.*b*.

In embodiments represented by FIG. 2, the transistor pairs in each of the transistor groups are configured as binary weighted transistor pairs. In this configuration, the channel lengths of all transistors of the transistor groups are equal. The channel widths of transistors in a transistor pair in a particular significant position are a multiple of two larger than the channel widths of transistors in a transistor pair in a lower significant position within the same transistor group. For example, transistors 262.N.a and 262.N.b have channel widths that are a multiple of two larger than the channel widths of transistors 262.1.*a* and 262.1.*b*. Thus, when N represents the number of transistor pairs in a transistor group, the channel width of each of the transistors of the first transistor pair is W and channel width of each of the transistors of the N-th transistor pair is $2^{N-1}$W. For example, in transistor group 262, each transistor in transistor pair 262.1 has a channel width equal to W, and each transistor in transistor pair 262.N has a channel width equal to $2^{N-1}$W. Further, transistors in the same transistor pair have equal channel width to channel length ratio. For example, transistors 262.1.*a* and 262.1.*b* have equal channel width to channel length ratio of W/L. Transistors 262.N.a and 262.N.b have an equal channel width to channel length ratio of $2^{N-1}$W/L. Other transistor pairs also have an equal channel width to channel length ratios as shown in FIG. 2.

The difference in channel widths among the transistor pairs allows them to pass unequal amounts of current. In embodiments represented by FIG. 2, a transistor pair with larger channel widths passes more current than a transistor pair with smaller channel widths. For example, transistor pair 262.N has channel width of $2^{N-1}$W, transistor pair 262.1 has channel widths of W, where $2^{N-1}$W is a multiple of two larger than W. Therefore, transistor pair 262.N passes more current than transistor pair 262.1.

In embodiments represented by FIG. 2, different values of C1–CN causes select unit 215 to select different transistor pairs with different channel widths. In some embodiment, currents flowing from nodes 220 and 222 to nodes 224 and 226 are proportional to the value of C1–CN. For example, a higher value of C1–CN causes select unit 215 to select transistor pairs with larger channel widths, thereby allowing more current to flow from nodes 220 and 222 to nodes 224 and 226. As another example, a lower value of C1–CN causes select unit 215 to select transistor pairs with smaller channel widths, thereby allowing less current to flow from nodes 220 and 222 to nodes 224 and 226.

Select unit 215 includes a plurality of switch groups 272, 274, 276, and 278. Each of the switch groups includes a plurality of switches. For example, switch group 272 includes switches 272.1 through 272.N. Switch group 274 includes switches 274.1 through 274.N. Switch group 276 includes switches 276.1 through 276.N. Switch group 278 includes switches 278.1 through 278.N.

In embodiments represented by FIG. 2, the number of switch groups equals the number of transistor groups. The number of switches equals the number of transistor pairs. Each switch group has each of the switches connected to a corresponding transistor pair to turn on or turn off the transistors. For example, in switch group 272, switch 272.1 connects to transistor pair 262.1 at the gates of transistors 262.1.*a* and 262.1.*b* at nodes 272.1.*a* and 272.1.*b*. Switch 272.N connects to transistor pair 262.N at nodes 272.N.a and 272.N.b. Other switch groups have their switches connected to their corresponding transistor pairs in a similar fashion as that of switch group 272.

Each switch has a switch input node connected to one of code input nodes 229.1 through 229.N to receive one of the C1–CN signals. For example, switch 272.1 has a switch input node connected to node 229.1 to receive the C1 signal. Switch 272.N has a switch input node connected to node 229.N to receive the CN signal. The switches in the same significant position among the transistor groups connect to the same code input node to receive the same code input signal. Switches 272.1, 274.1, 276.1, and 278.1 connect to the same code input node 229.1 to receive the C1 signal. Switches 272.N, 274.N, 276.N, and 278.N connect to the same code input node 229.N to receive the CN signal. In this arrangement, select unit 215 applies the same selection to transistor pairs in the same significant position among the transistor groups based on certain code input signals. Transistor pairs 262.1, 264.1, 266.1, and 268.1 will have their transistors selected in the same way based on the signal value of C1 at node 229.1.

In some embodiments, each of the code input signals has signal levels that represent different signal values. In embodiments represented by FIG. 2, each of the code input signals has a signal level that represents a binary zero (or logic 0), and another signal level that represents a binary one (or logic 1). Thus, C1–CN are binary code signals and a combination of the C1–CN signals represents a binary code. In some embodiments, the amount of current flowing from nodes 220 and 222 to nodes 224 and 226 depends on the value of the binary code. In embodiments represented by FIG. 2, the amount of current flowing from nodes 220 and 222 to nodes 224 and 226 is proportional to the value of the binary code.

Each of switches of switch groups 272, 274, 276, and 278 causes one transistor of a transistor pair of transistors groups 262, 264, 266, and 268 to turn on and the other transistor in the same transistor pair to turn off based on the signal level of the code input signal received by the switch. When a transistor turns on, it passes current. When a transistor turns off, it passes no current. Since each transistor pair has two current paths, each switch causes a corresponding transistor pair to pass a current from a corresponding common source to node 280 via one current path, or to one of nodes 224 and 226 via another current path. For example, when switch 272.1 turns off transistor 262.1.*a* and turns on transistor 262.1.*b* based on one signal level of the C1 signal, transistor pair 262.1 passes a current from node 220 to node 280 via transistor 262.1.*b*, and passes no current from node 220 to node 224. When switch 272.1 turns on transistor 262.1.*a* and turns off transistor 262.1.*b* based on another level signal of the C1 signal, transistor pair 262.1 passes no current from node 220 to node 280, and passes a current from node 220 to node 224 via transistor 261.1.*a*.

Figure 3:
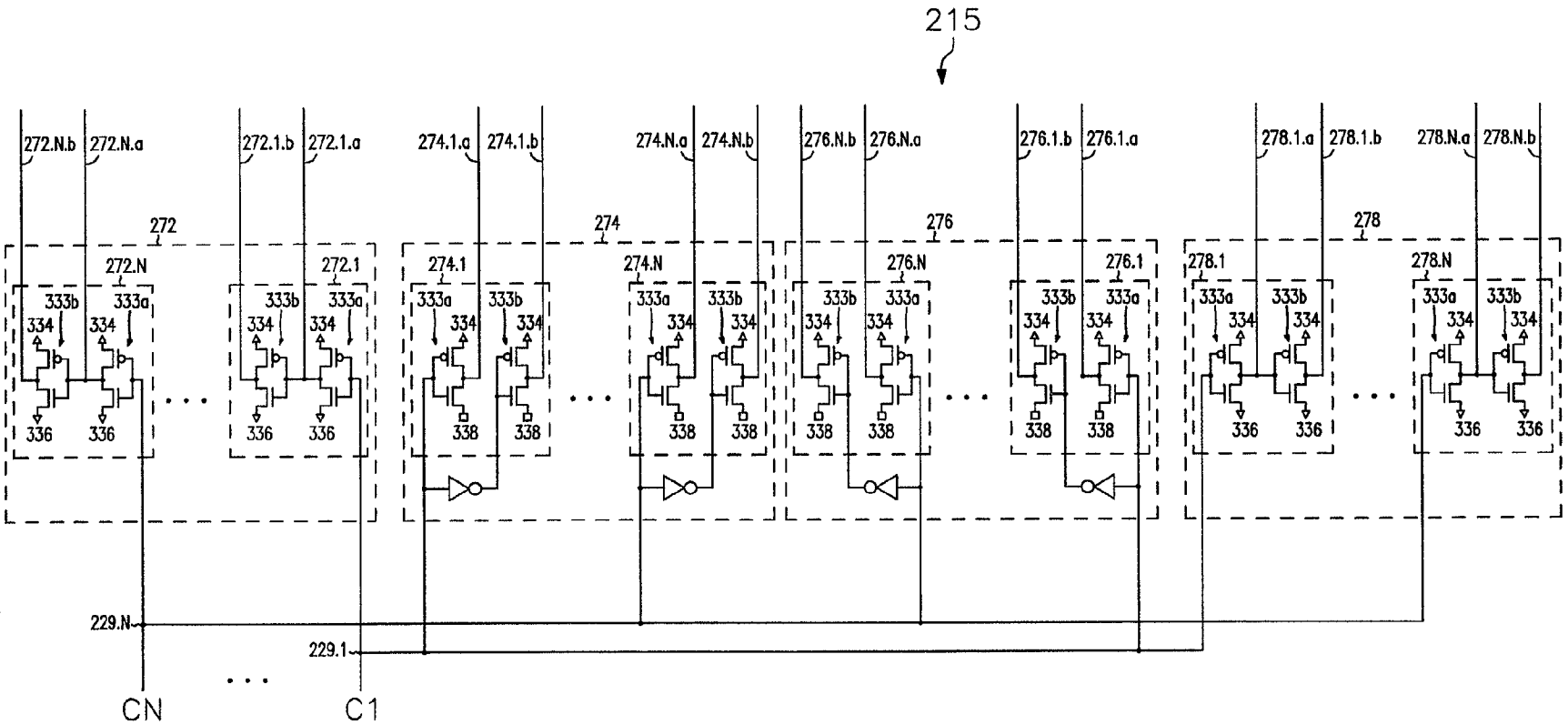
FIG. 3 shows a schematic diagram of a select unit of FIG. 2.

FIG. 3 shows a schematic diagram of select unit 215 of FIG. 2. In embodiments represented by FIG. 3, each switch of switch groups 272, 274, 276, and 278 includes a first inverter 333*a* and a second inverter 333*b*. For simplicity, the inverters of all of the switches have the same reference numbers. In switch groups 272 and 278, each of inverters 333*a* and 333*b* connects to supply nodes 334 and 336. In switch groups 274 and 276, each of inverters 333*a* and 333*b* connects to node 334 and supply node 338. In some embodiments, nodes 336 and 338 have the same potential. In some other embodiments, nodes 336 and 338 have unequal potential. In embodiments represented by FIG. 3, node 338 has a higher potential than node 336. The potential of node 338 can be selected to adjust the linearity between the input signals V1 and V2 and the output currents IS and 16.

Each of the switches connects to one of the code input nodes at the switch input node, which is also the input of one of the inverters. For example, switch 272.1 connects to node 229.1 at the input of inverter 333*a*. In each switch, the output of each inverter connects to the gate of a corresponding transistor of a corresponding transistor pair. For example, the output of inverter 333*a* connects to the input of inverter 333*b* and the gate of transistor 262.1.*a* at node 272.1.*a*. The output of inverter 333*b* connects to the gate of transistor 262.1.*b* at node 272.1.*b*.

In embodiments represented by FIG. 3, each switch causes one transistor of a corresponding transistor pair to turn on and the other transistor of the same corresponding transistor pair to turn off based on the signal level of the code input signal received by the switch. For example, when C1 represents a binary zero, node 272.1.*a* is high and node 272.1.*b* is low. This causes transistor 262.1.*a* to turn off and transistor 262.1.*b* to turn on. Thus, in transistor pair 262.1, current will flow from node 220 to node 280 via transistor 262.1.*b* and no current will flow from node 220 to node 224 because transistor 262.1.*a* is off. Other transistor pairs of other transistor groups act in a similar fashion. For example, in transistor pair 264.1, current will flow from node 220 to node 280 via transistor 264.1.*b* and no current will flow from node 220 to node 226. In transistor pair 266.1, current will flow from node 222 to node 280 via transistor 266.1.*b* and no current will flow from node 222 to node 224. In transistor pair 268.1, current will flow from node 222 to node 280 via transistor 268.1.*b* and no current will flow from node 222 to node 226.

As another example, when C1 represents a binary one, nodes 272.1.*a* and 272.1.*b* have opposite levels from the case when C1 represents a binary zero. In this example, node 272.1.*a* is low and node 272.1.*b* is high. This causes transistor 262.1.*a* to turn on and transistor 262.1.*b* to turn off. Thus, in transistor pair 262.1, current will flow from node 220 to node 224 via transistor 262.1.*a* and no current will flow from node 220 to node 280. Other transistor pairs of other transistor groups act in a similar fashion. For example, at transistor pair 264.1, current will flow from node 220 to node 226 via transistor 264.1.*a* and no current will flow from node 220 to node 280. At transistor pair 266.1, current will flow from node 222 to node 224 via transistor 266.1.*a* and no current will flow from node 222 to node 280. At transistor pair 268.1, current will flow from node 222 to node 226 via transistor 268.1.*a* and no current will flow from node 222 to node 280.

The transistor pairs in the same group have different widths and the amount of current flowing through a transistor pair is proportional to the widths of the transistors of the transistor pair. Furthermore, since a transistor pair in a higher significant position has larger channel width than a transistor pair in a lower significant position, the transistor pair in the higher significant position passes more current from a corresponding common source to node 224 or node 226 than the transistor pair in the lower significant position. Therefore, the amount of current flowing to nodes 224 and 226 (I5 and I6) is proportional to the binary code represented by the C1–CN signals. For example, binary code 1000 (N=4, CN=1, other bits are zeros) causes more current to flow to nodes 224 and 226 than binary code 0111 (CN=0, other bits are ones). When CN=1 (in binary code 1000), switches 272.N and other switches in the same Nth position turn on transistor 262.N.a and other transistor pairs in the N-th positions in other transistor groups. Since transistor 262.N.a and other transistors in the N-th position have $2^{N-1}$W channel width, they pass more current to nodes 224 and 226 (when CN=1) than a combination of other transistors in lower positions (when CN=0).

Figure 4:
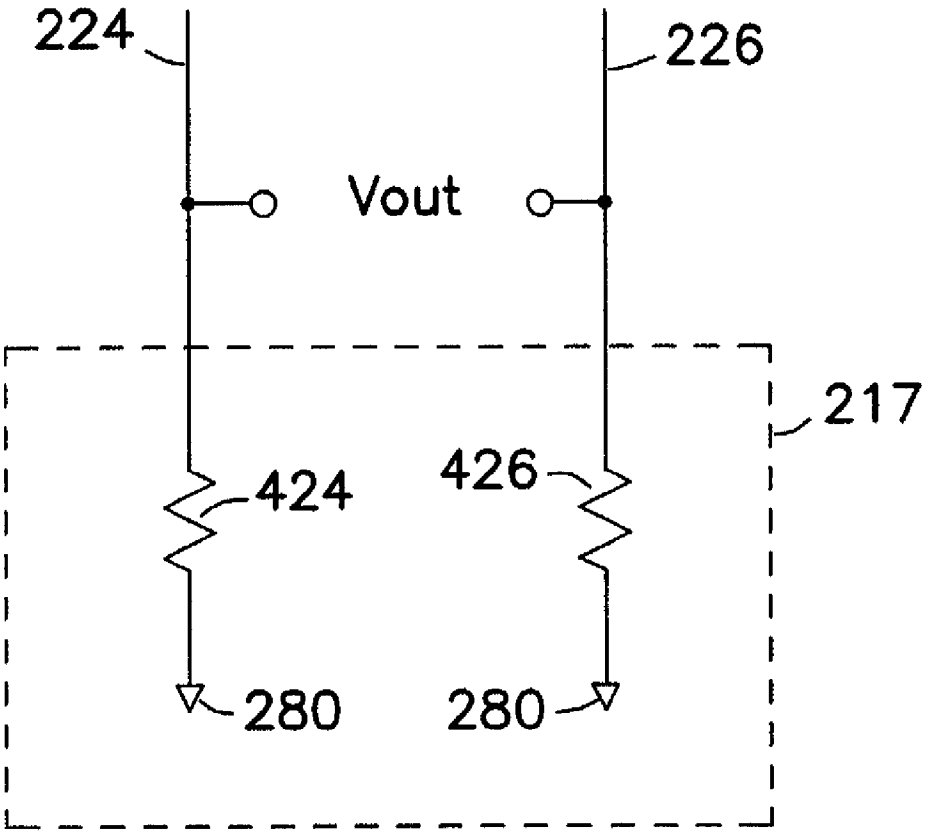
FIG. 4 shows a schematic diagram of a load unit of FIG. 2.

FIG. 4 is a schematic diagram of load unit 217. Load unit 217 includes a first load element and a second load element. In embodiments represented by FIG. 4, resistor 424 represents the first load element, and resistor 426 represents the second load element. In some embodiments, the first and second load elements are non-resistors. Resistor 424 connects to node 224 and node 280. Resistor 426 connects to node 226 and node 280. Vout is proportional to the values of resistors 424 and 426.

Figure 5:
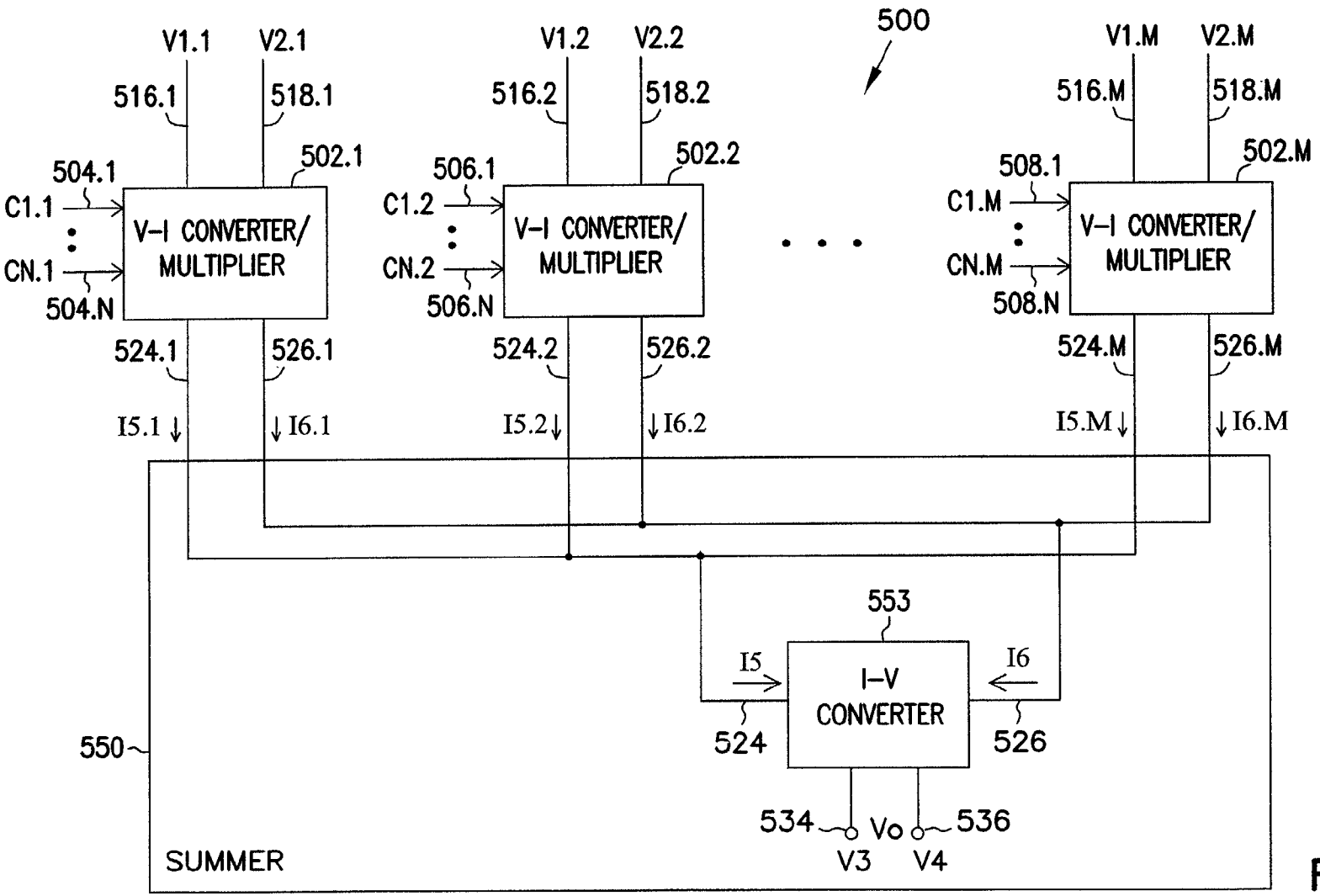
FIG. 5 shows a functional unit.

FIG. 5 shows a block diagram of a functional unit 500. Functional unit 500 includes a plurality of voltage-to-current (V-I) converter/multipliers 502.1, 502.2 through 502.M, and a summer 550. Each of the V-I converter/multipliers has multiplier input nodes and multiplier output nodes. For example, V-I converter/multiplier 502.1 has multiplier input nodes 516.1 and 518.1 to receive multiplier input signals V1.1 and V2.1, and multiplier output nodes 524.1 and 526.1 to provide output currents I5.1 and I6.1. As another example, V-I converter/multiplier 502.M has multiplier input nodes 516.M and 518.M to receive multiplier input signals V1.M and V2.M, and multiplier output nodes 524.M and 526.M to provide output currents I5.M and I6.M. Each of the V-I converter/multipliers also connects to a corresponding set of code input nodes to receive a corresponding combination of code input signals. For example, V-I converter/multiplier 502.1 connects to code input nodes 504.1 through 504.N to receive code input signals C1.1–CN.1. V-I converter/multiplier 502.2 connects to code input nodes 506.1 through 506.N to receive code input signals C1.2–CN.2. V-I converter/multiplier 502.M connects to code input nodes 508.1 through 508.N to receive code input signals C1.M–CN.M.

Summer 550 includes a current-to-voltage (I-V) converter 553, summing nodes 524 and 526, and output nodes 534 and 536. Nodes 524 and 526 receive currents I5 and I6, I-V converter 553 converts currents I5 and I6 into voltages V3 and V4. Summer 550 further provides an output voltage Vo, which is the difference between V3 and V4 at nodes 534 and 536. Summer 550 sums currents I5.1 through I5.M to produce I5 at node 524. Thus, I5 equals the sum of I5.1 through I5.M. Summer 550 sums currents I6.1 through I6.M to produce I6 at node 526. Thus, I6 equals the sum of I6.1 through I6.M.

I-V converter 553 can be any I-V converter known to those skilled in the art. For example, I-V converter 553 can be a differential I-V converter that converts differential input currents into differential output voltages, in which the differential output voltages are proportional to the differential input currents. Any I-V converter capable of converting input currents into output voltages can be used in alternative embodiments of the present invention.

Each of V-I converter/multipliers 502.1 through 502.M is similar to and operates in a similar fashion as multiplier 200 (FIG. 2). Each of V1.1 through V1.M is similar to V1 (FIG. 2). Each of V2.1 through V2.M is similar to V2 (FIG. 2). Each of I5.1 through I5.M is similar to I5 (FIG. 2). Each of I6.1 through I6.M is similar to I6 (FIG. 2). Code input signals C1.1–CN.1, C1.2–CN.2, and C1.M–CN.M are similar to code input signals C1–CN (FIG. 2).

Functional unit 500 can be a part of a signal filter such as a finite impulse response (FIR) filter, an equalizer, or other device that receives one or more signals and performs multiplication, or addition, or both to the signals. In some embodiments, functional unit 500 performs the multiplication and addition to signals received at a receiver to restore the signals to their original form, when the signals are distorted during transmission.

Figure 6:
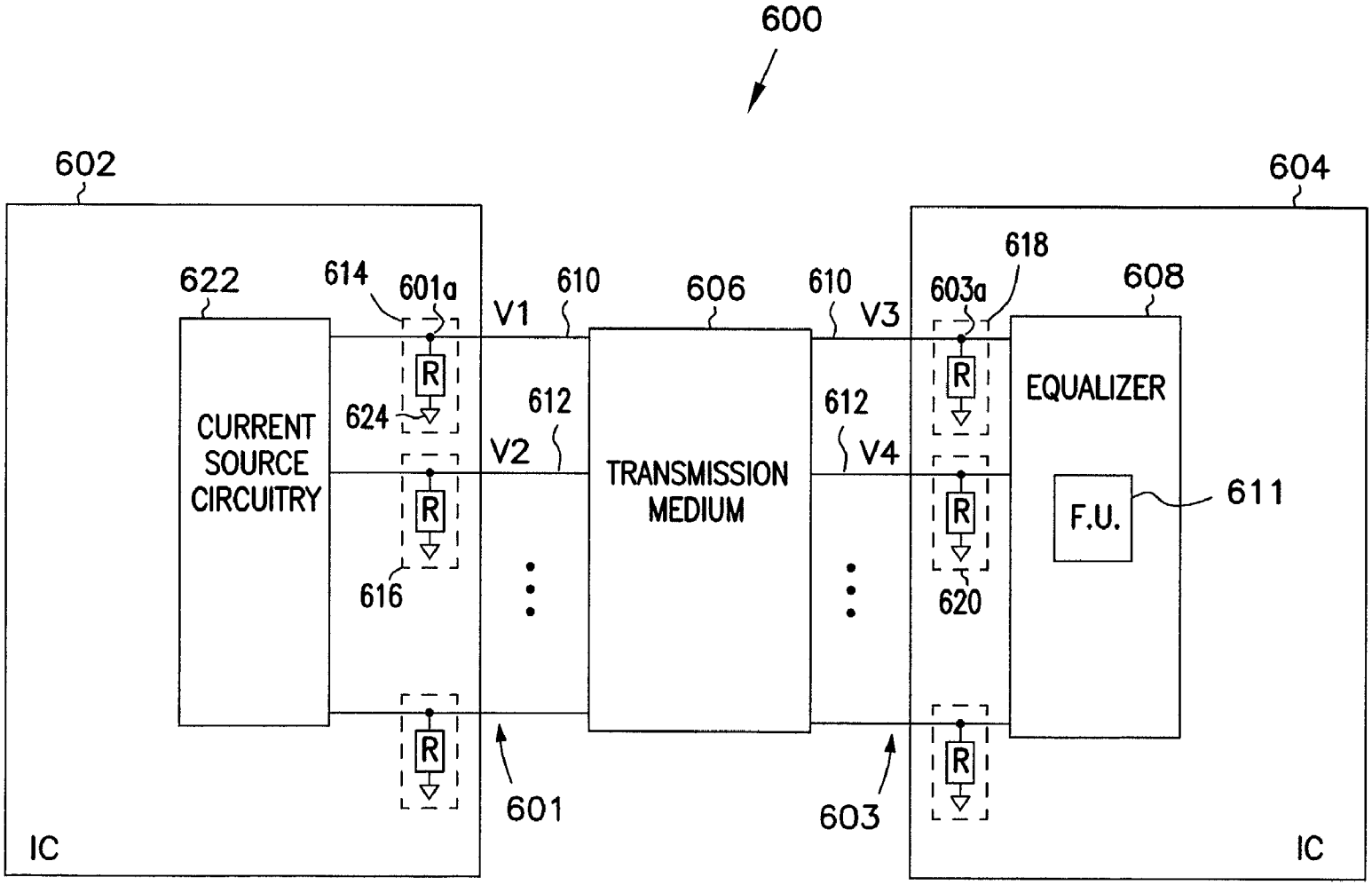
FIG. 6 shows a system.

FIG. 6 shows a system. System 600 includes an integrated circuit (IC) 602, an IC 604, and a transmission medium 606 connected between ICs 602 and 604 for data communication between IC 602 and IC 604. In some embodiments, transmission medium 606 connects to IC 602 at nodes 601 and IC 604 at nodes 603. IC 604 includes an equalizer 608. Equalizer 608 includes a functional unit (F.U.) 610. Functional unit 610 represents functional unit 500 (FIG. 5). In embodiments represented by FIG. 6, IC 602 represents a transmitter to transmit a plurality of signals to IC 604, which represents a receiver.

In some embodiments, transmission medium 606 is a point-to-point transmission medium having a plurality of transmission lines such as transmission lines 610 and 612. Each of the transmission lines connects to a termination impedance of IC 602 and a termination impedance of IC 604. For example, transmission lines 610 and 612 connect to termination impedances 614 and 616 of IC 602, and connect to termination impedances 618 and 620 of IC 604. Each of the termination impedances includes a resistive element (R) connected to the corresponding transmission line and a supply node. A resistive element of IC 602 connects to the corresponding transmission line at a driver node. A resistive element of IC 604 connects to the corresponding transmission line at a receiver node. For example, the resistive element of termination impedance 614 connects to transmission line 610 at driver node 601*a*. The resistive element of termination impedance 618 connects to transmission line 610 at receiver node 603*a*. Each of the resistive elements connects to supply node 624. In some embodiments, supply node 624 connects to ground. In other embodiments, supply node 624 connects to a non-zero voltage.

IC 602 includes a current source circuitry 622 to source a driver current onto each of the transmission lines. A portion of the driver current develops a voltage at the driver node. Another portion of the driver current travels on the transmission medium and develops a voltage at the receiver node. V1, V2, V3, and V4 indicate the voltages developed at the driver nodes of IC 602 and at the receiver nodes of IC 604.

In some embodiments, equalizer 608 samples V3 and V4 to produce a plurality of sampled signals. For example, in some embodiments, equalizer 608 samples V3 to produce sampled signals such as the V1.1 through V1.M signals (FIG. 5), and samples V4 to produce sampled signals such as the V2.1 through V2.M signals (FIG. 5). During a signal processing operation, equalizer 608 performs multiplication and addition to V1.1 through V1.M and V2.1 through V2.M to restore the original form of the V1 and V2 signals, when they are distorted during transmission from IC 602 to IC 604.

IC 602 and IC 604 can be any type of integrated circuit. For example, IC 602 or IC 604 can be a processor such as a microprocessor, a digital signal processor, a microcontroller, or the like. IC 602 and IC 604 can also be an integrated circuit other than a processor such as an application-specific integrated circuit, a communications device, a memory controller, or a memory such as a dynamic random access memory.

System 600 can be of any type. Examples of system 600 include computers (e.g., desktops, laptops, handhelds, servers, Web appliances, routers, etc.), wireless communications devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. A circuit comprising:

a pair of input transistors to source a first current to a first source node and a second current to a second source node; and a plurality of transistor pairs connected between the first and second source nodes and a first summing node and a second summing node, wherein each of the transistor pairs includes:

a first transistor to pass a portion of a current from one of the first and second currents to a reference node; and a second transistor to pass another portion of the one of the first and second currents to one of the first and second summing nodes.

2. The circuit of claim 1, wherein the first transistor and the second transistor have equal channel widths.

3. The circuit of claim 2, wherein the plurality of transistor pairs are grouped in transistor groups, wherein within the same transistor group, a transistor pair has channel widths unequal to channel widths of another transistor pair.

4. The circuit of claim 3, wherein the plurality of transistor pairs are binary weighted transistor pairs.

5. The circuit of claim 1 further comprising a current reduction unit connected between the pair of input transistors to subtract a DC current.

6. The circuit of claim 5 further comprising a select unit connected to the plurality of transistor pairs to select the plurality of transistor pairs to form a plurality of current paths from each of the first and second source nodes to the first and second summing nodes.

7. The circuit of claim 6, wherein the select unit includes a plurality of switches, each of the switches being connected to a corresponding transistor pair.

8. The circuit of claim 7, wherein each of the switches includes an input node to receive a code input signal to turn on the first transistor of the corresponding transistor pair based on one level of the code input signal, and to turn on the second transistor of the corresponding transistor pair based on another level of the code input signal.

9. The circuit of claim 8, wherein the plurality of transistor pairs are grouped in transistor groups, wherein within the same transistor group, a transistor pair has channel widths that are a multiple of channel widths of another transistor pair.

10. A circuit comprising:

a first input transistor and a second input transistor;

a first transistor group and a second transistor group connected to the first input transistor at a first source node;

a third transistor group and a fourth transistor group connected to the second input transistor at a second source node, each of the first, second, third, and fourth transistor groups including a plurality of weighted transistor pairs; and a plurality of switches, each of the switches being connected to one of the weighted transistor pairs.

11. The circuit of claim 10 further comprising a current source connected to the first source node.

12. The circuit of claim 11 further comprising a second current source connected to the second source node.

13. The circuit of claim 12, wherein each of the weighted transistor pairs includes transistors having equal channel widths.

14. The circuit of claim 13, wherein the weighted transistor pairs in each of the first, second, third, and fourth transistor groups are binary weighted transistor pairs.

15. The circuit of claim 10 further comprising:

a first summing node connected to the weighted transistor pairs of the first and third transistor groups; and a second summing node connected to the weighted transistor pairs of the second and fourth transistor groups.

16. The circuit of claim 15 further comprising:

a first load element connected between the first summing node and a supply node;

a second load element connected between the second summing node and the supply node; and a pair of output nodes connected to the first and second load elements to provide a double-ended signal.

17. The circuit of claim 16 further comprising a plurality of code input nodes connected to the switches to receive a plurality of code input signals to configure the switches.

18. An integrated circuit comprising:

a plurality of multipliers to receive a plurality of multiplier input signals and a plurality of code input signals; and a summer connected to the multipliers to sum currents at a first summing node and a second summing node, wherein each of the multipliers includes:

an input stage connected to a first source node and a second source node;

a plurality of transistor groups connected to the first and second source nodes, each of the transistor groups including a plurality of transistor pairs; and a plurality of switches connected to the transistor pairs to select the transistor pairs to form a plurality of current paths from the first and second source nodes to the first and second summing nodes.

19. The integrated circuit of claim 18 further comprising a current reduction unit connected between the first and second source nodes.

20. The integrated circuit of claim 19, wherein the summer includes a current-to-voltage converter connected to the first and second summing nodes to convert currents at the first and second summing nodes into an output voltage.

21. The integrated circuit of claim 20, wherein the transistor pairs of each of the transistor groups are binary weighted transistor pairs.

22. The integrated circuit of claim 18, wherein the transistor pairs of each of the transistor groups are weighted.

23. The integrated circuit of claim 22, wherein the transistor pairs of each of the transistor groups arrange in a low-to-high significant position within the same transistor group, wherein a transistor pair in a significant position has channel widths that are a multiple of channel widths of another transistor pair in a lower significant position.

24. The integrated circuit of claim 23, wherein each of the transistor groups includes the same number of transistor pairs.

25. The integrated circuit of claim 24 further comprising a plurality of nodes to receive a plurality of input signals to produce the multiplier input signals.

26. A system comprising:

a transmitter;

a point-to-point transmission medium connected to the transmitter to transmit a plurality of transmitted signals; and a receiver connected to the point-to-point transmission medium to receive the transmitted signals and produce a plurality of sampled signals, the receiver including:

a plurality of multipliers to receive the plurality of sampled signals and a plurality of code input signals; and a summer connected to the multipliers to sum currents at a first summing node and a second summing node, wherein each of the multipliers includes:

an input stage connected to a first source node and a second source node;

a plurality of transistor groups connected to the first and second source nodes, each of the transistor groups including a plurality of transistor pairs; and a plurality of switches connected to the transistor pairs to select the transistor pairs to form a plurality of current paths from the first and second source nodes to the first and second summing nodes.

27. The integrated circuit of claim 26, wherein the transistor pairs of each of the transistor groups are binary weighted transistor pairs.

28. The integrated circuit of claim 27 further comprising a current reduction unit connected between the first and second source nodes.

29. The circuit of claim 26, wherein the point-to-point transmission medium includes a plurality of transmission lines, each connecting to a termination impedance of the transmitter and a termination impedance of the receiver.

30. The circuit of claim 29, wherein the transmitter includes a current source circuitry to source a driver current onto the termination impedances of the transmitter and the receiver.

* * * * *